US006481095B1

(12) United States Patent
Mizuno

(10) Patent No.: US 6,481,095 B1
(45) Date of Patent: Nov. 19, 2002

(54) CUP ATTACHING APPARATUS

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/653,206

(22) Filed: Aug. 31, 2000

(30) Foreign Application Priority Data

Aug. 31, 1999 (JP) ..... 11-244337

(51) Int. Cl.[7] ..... B24B 13/00

(52) U.S. Cl. ..... 29/702; 29/703; 29/709; 29/720; 29/407.01; 29/407.04; 29/407.05; 451/42

(58) Field of Search ..... 29/20, 407.01, 29/407.04, 407.05, 407.09, 407.1, 557, 702, 703, 707, 709, 720; 356/124, 125, 127; 264/21; 451/42, 240, 255, 256, 277, 323

(56) References Cited

U.S. PATENT DOCUMENTS

| | | | | |
|---|---|---|---|---|
| 4,737,918 A | | 4/1988 | Langlois et al. | 364/474 |
| 4,798,459 A | | 1/1989 | Joncour | 356/127 |
| 5,155,940 A | | 10/1992 | Suzuki | 51/165.71 |
| 5,347,762 A | | 9/1994 | Shibata et al. | 451/15 |
| 5,498,200 A | * | 3/1996 | Werner | 451/42 |
| 5,716,256 A | | 2/1998 | Mizuno et al. | 451/5 |
| RE35,898 E | | 9/1998 | Shibata et al. | 451/5 |

FOREIGN PATENT DOCUMENTS

| | | | | |
|---|---|---|---|---|
| DE | 38 29 488 A1 | | 3/1990 | G02C/13/00 |
| EP | 0 363 281 | | 4/1990 | G02C/13/00 |
| EP | 0 409 760 A1 | | 1/1991 | B24B/9/14 |
| EP | 0426551 A1 | * | 5/1991 | |
| EP | 0 753 781 A2 | | 1/1997 | G02C/13/00 |
| EP | 0 876 874 A2 | | 11/1998 | B24B/13/005 |
| EP | 0 933 163 A1 | | 8/1999 | B24B/13/005 |
| EP | 0947287 A1 | * | 10/1999 | |
| JP | 02210238 A1 | * | 8/1990 | 356/124 |
| JP | 3-113415 | | 5/1991 | G02C/13/00 |
| JP | 403113415 A1 | * | 5/1991 | 29/20 |
| JP | 403113416 A1 | * | 5/1991 | 29/20 |
| JP | 403113417 A1 | * | 5/1991 | 29/20 |
| JP | 3-149168 | | 6/1991 | B24B/9/14 |
| JP | 404018516 A1 | * | 1/1992 | 29/20 |
| JP | 5-212661 | | 8/1993 | B24B/9/14 |
| JP | 8-18236 | | 2/1996 | B24B/9/14 |
| JP | 9-253999 | | 9/1997 | B24B/9/14 |
| JP | 2786848 | | 5/1998 | B24B/9/14 |

OTHER PUBLICATIONS

Patent Abstract of Japan 09183052 Jul. 15, 1997.

* cited by examiner

*Primary Examiner*—David P. Bryant
*Assistant Examiner*—Jermie E. Cozart
(74) *Attorney, Agent, or Firm*—Sughrue Mion, PLLC

(57) ABSTRACT

A cup attaching apparatus includes: a cup attaching system for moving a cup to a lens placed at a predetermined position, and attaching the cup onto the lens; a detecting system, provided with a measurement optical system having a measurement light source, a measurement index plate and an photoelectric detector, for detecting a position of an optical center of the lens; a display system for displaying a positional offset of the lens relative to a predetermined reference position based on a result of detection by the detecting system; a data-input system for inputting data on a target lens shape or a traced outline and a layout of the lens; a memory for storing data on shapes of plural types of cups; and a selecting system for selecting a cup, which will not interfere with an abrasive wheel during processing of the lens, based on inputted data and stored data on the shapes of the cups.

23 Claims, 7 Drawing Sheets

CUP ATTACHING APPARATUS

BACKGROUND OF THE INVENTION

The present invention relates to a cup attaching apparatus for attaching a cup, i.e., a processing jig, to an eyeglass lens which is processed by an eyeglass lens processing apparatus.

As a preliminary-step operation prior to grinding a peripheral edge of an eyeglass lens by an eyeglass lens processing apparatus, a cup (a suction cup, a cup which is fixed with a pressure sensitive adhesive sheet placed in between, or the like), i.e., a processing jig, is attached to an eyeglass lens (subject lens) by means of a cup attaching apparatus, or a so-called aligning apparatus.

In general, a circular cup (a full-eye cup) designed for normal lenses is attached to the lens. The full-eye cup has a circular outer circumferential configuration to secure its fixing force. However, when the lens is processed into a half-eye lens (crab eye lens) or lens for reading glass (granny's glasses) (which is often used for eyeglasses for the aged) having a narrow vertical length, the use of the circular cup for normal lenses will causes processing interference (interference with an abrasive wheel). To avoid the interference, a cup for a half-eye lens (half-eye cup), whose outer circumferential shape is oval (whose upper and lower portions have been cut away) is used.

The determination as to whether the full-eye cup or the half-eye cup is to be used as the cup to be attached to the lens has been made by an operator upon comparison of a target lens shape (traced outline) of an eyeglass frame, a template (pattern), a dummy lens, or the like with the outer circumferential shape of the cup while taking into consideration the relationship of the layout of the position of the optical center with the target lens shape (traced outline).

However, this determination requires experience, the confirmation operation is troublesome, and it has been difficult for an unskilled operator to attach an appropriate cup. In addition, there is a possibility that in a case where a half-eye cup should be attached, even a skilled operator may attach a full-eye cup by mistake.

Further, in processing centers where lenses are processed in a mass production manner, the attachment of cups is effected through division of labor in many cases. In this case, if confirmation is made on each occasion of the processing step as to whether or not an appropriate cup has been attached, the efficiency is poor. Furthermore, if it is known that the cup was inappropriate only after the processing has been carried out, it can lead to trouble on the lens processing apparatus side.

SUMMARY OF THE INVENTION

In view of the above-described drawbacks, it is an object of the present invention to provide a cup attaching apparatus which makes it possible for even an unskilled operator to easily determine the type of an appropriate cup at the time of attaching the cup, and which makes it possible to prevent the error of attaching an inappropriate cup.

To attain the above-noted object, the present invention provides the following.

A cup attaching apparatus for attaching an appropriate one of cups onto an eyeglass lens, each cup being adapted to fix the eyeglass lens onto a lens rotating shaft of a lens processing apparatus. The cup attaching apparatus comprises cup attaching means for moving a cup to a lens placed at a predetermined position, and attaching the cup onto the lens; detecting means, provided with a measurement optical system having a measurement light source, a measurement index plate and an photoelectric detector, for detecting a position of an optical center of the lens; display means for displaying a positional offset of the lens relative to a predetermined reference position based on a result of detection by the detecting means; data input means for inputting data on a target lens shape or a traced outline and a layout of the lens; a memory for storing data on shapes of plural types of cups; and selecting means for selecting a cup, which will not interfere with an abrasive wheel during processing of the lens, based on inputted data and stored data on the shapes of the cups.

According to another aspect of the invention, the cup attaching apparatus further comprises display controlling means for controlling the display means to display the result of selection by the selecting means.

According to another aspect of the invention, the display controlling means controls the display means to graphically display a shape of the cup selected.

According to yet another aspect of the invention, a cylinder axis angle inputting means is provided for inputting a cylinder axis angle indicated in a prescription, wherein the detecting means further detects a cylinder axis angle of the lens, and wherein the display means displays a guide instruction for rotating at least one of the cup and the lens, based on the inputted cylinder axis angle and the detected cylinder axis angle.

According to another aspect of the present invention, the display means superimposes and displays an optical center mark indicative of the detected position of the optical center, a target lens shape mark based on the inputted data, and a cup mark based on the stored data on the shapes of the cups, the cup mark including a mark indicative of a center of the cup.

According to still another aspect of the invention, the cup attaching apparatus further comprises lens shape inputting means for inputting an outer circumferential shape of the lens, wherein the display means superimposes and displays a lens mark based on the inputted outer circumferential shape of the lens, a target lens shape mark based on the inputted data, and a cup mark based on the stored data on the shapes of the cups, the lens mark including a mark indicative of the optical center of the lens, and the cup mark including a mark indicative of a center of the cup.

According to yet another aspect of the invention, the lens shape inputting means includes imaging means for imaging the lens placed at the predetermined position.

According to still another aspect of the invention, the plural types of the cups includes a circular cup for normal lenses and an oval cup for half-eye lenses.

According to still another aspect of the invention, the cup attaching apparatus further comprises cup detecting means for detecting a type of the cup held by the cup attaching means; and inhibiting means for inhibiting the attachment of the cup by the cup attaching means if the result of selection by the selecting means is not identical to a result of detection by the cup detecting means.

According to still another aspect of the invention, the cup attaching apparatus further comprises cup detecting means for detecting a type of the cup held by the cup attaching means; and notifying means for notifying a fact that the result of selection by the selecting means is not identical to a result of detection by the cup detecting means.

According to still another aspect of the invention, the cup attaching apparatus further comprises judging means for judging whether or not the detected position of the optical center falls within a predetermined range with respect to the predetermined reference position; cup detecting means for detecting a type of the cup held by the cup attaching means; and instructing means for instructing the cup attaching means to attach the cup if the judging means judges that the detected position of the optical center falls within the predetermined range and the result of selection by the selecting means is identical to a result of detection by the cup detecting means.

According to still another aspect of the invention, the cup attaching apparatus further comprises transmitting means for transmitting data to the lens processing apparatus. According to still another aspect of the invention, the cup attaching apparatus further comprises storing means for storing an amount of the positional offset of the lens with respect to the predetermined reference position at the time of cup attachment; and transmitting means for transmitting the stored amount of the positional offset of the lens to the lens processing apparatus.

According to yet another aspect of the invention, the predetermined reference position includes a position of a center about which the cup is to be attached.

The invention also provides a cup attaching apparatus for attaching an appropriate one of cups onto an eyeglass lens, each cup being adapted to fix the eyeglass lens onto a lens rotating shaft of a lens processing apparatus, the cup attaching apparatus comprising: cup attaching means for moving a cup to a lens placed at a predetermined position, and attaching the cup onto the lens; detecting means, provided with a measurement optical system having a measurement light source, a measurement index plate and an photoelectric detector, for detecting a position of an optical center of the lens and a direction of a cylinder axis of the lens; data input means for inputting data on a target lens shape or a traced outline and a layout of the lens; a memory for storing data on shapes of plural types of cups; and display means for relatively displaying a cup mark with respect to an optical center mark and relatively displaying a target lens shape mark with respect to the optical center mark, the cup mark being based on stored data on the shapes of the cups and including a mark indicative of a center of the cup, the optical center mark being indicative of the detected position of the optical center and the target lens shape mark being based on the inputted data.

According to still another aspect of the invention, the cup attaching apparatus further comprises selecting means for selecting a cup, which will not interfere with an abrasive wheel during processing of the lens, based on the inputted data and the data on the shapes of the cups.

According to still another aspect of the invention, the cup mark is displayed by the displaying means based on a result of selection by the selecting means.

According to still another aspect of the invention, the selecting means selects a circular cup with priority.

According to still another aspect of the invention, the cup attaching apparatus further comprises cylinder axis angle inputting means for inputting an angle of the cylinder axis indicated in a prescription, wherein the display means relatively displays a first axis mark based on the inputted angle of the cylinder axis and a second axis mark based on the detected direction of the cylinder axis with respect to the optical center mark.

According to still another aspect of the invention, the cup attaching apparatus further comprises lens shape inputting means for inputting an outer circumferential shape of the lens, wherein the display means relatively displays a lens mark based on the inputted outer circumferential shape of the lens with respect to the optical center mark.

According to still another aspect of the invention, the plural types of the cups includes a circular cup for normal lenses and an oval cup for half-eye lenses.

According to still another aspect of the invention, the cup attaching apparatus further comprises cup detecting means for detecting a type of the cup held by the cup attaching means; and inhibiting means for inhibiting the attachment of the cup by the cup attaching means if the result of selection by the selecting means is not identical to a result of detection by the cup detecting means.

According to still another aspect of the invention, the cup attaching apparatus further comprises cup detecting means for detecting a type of the cup held by the cup attaching means; and notifying means for notifying a fact that the result of selection by the selecting means is not identical to a result of detection by the cup detecting means.

According to still another aspect of the invention, the cup attaching apparatus further comprises judging means for judging whether or not the detected position of the optical center falls within a predetermined range with respect to a position of a center about which the cup is to be attached; cup detecting means for detecting a type of the cup held by the cup attaching means; and instructing means for instructing the cup attaching means to attach the cup if the judging means judges that the detected position of the optical center falls within the predetermined range and the result of selection by the selecting means is identical to a result of detection by the cup detecting means.

DESCRIPTION OF THE PREFERRED EMBODIMENT

Figure 1:
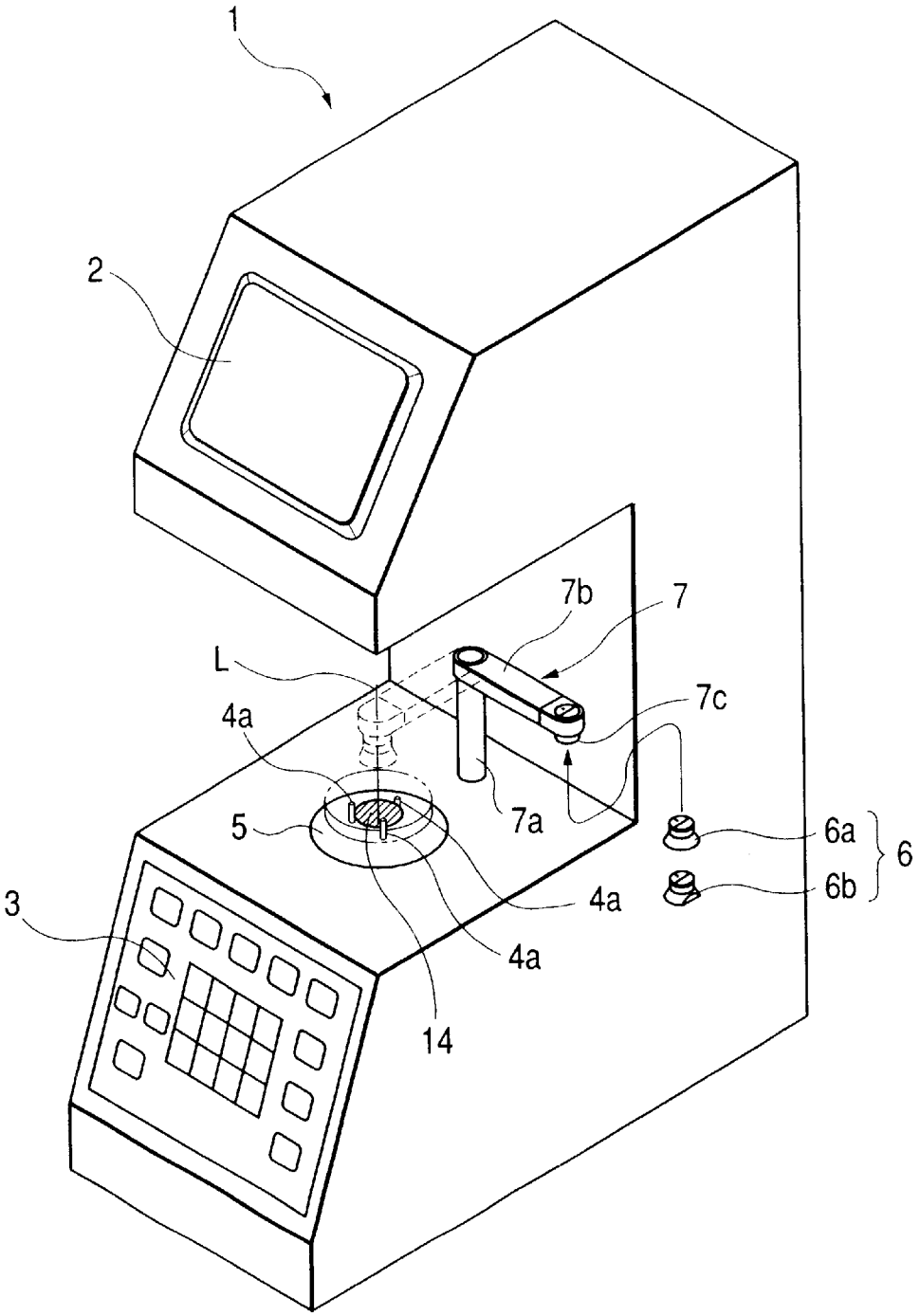
FIG. 1 is an external view of a cup attaching apparatus in accordance with an embodiment of the invention.
Figure 2:
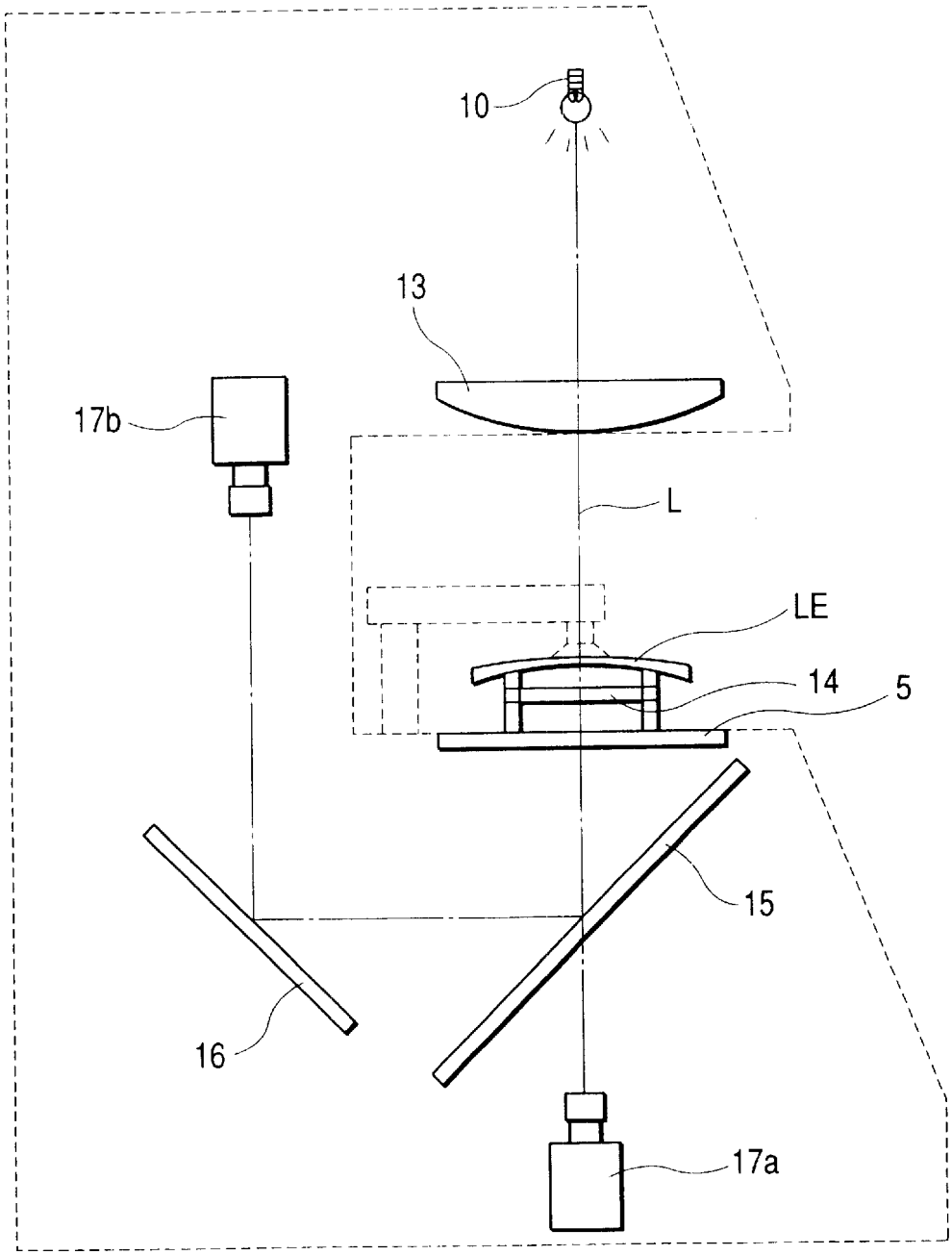
FIG. 2 is a schematic diagram of an optical system of the apparatus.

Referring now to the drawings, a description will be given of a cup attaching apparatus in accordance with a first embodiment of the invention. FIG. 1 is an external view of the apparatus, and FIG. 2 is a schematic diagram of an optical system provided in the apparatus. Reference numeral 1 denotes an apparatus main body having substantially U-shaped side surfaces, and an illuminating optical system and an imaging optical system shown in FIG. 2 are disposed therein. A color monitor 2 such as a liquid-crystal display is provided on an upper front surface of the main body 1, and a switch panel 3 is provided on a lower front surface. Displayed on the monitor 2 are an image of a subject lens LE which is imaged by a second CCD camera 17*b,* various marks for alignment, a layout screen (including input items for layout), and the like (described later).

Figure 5:
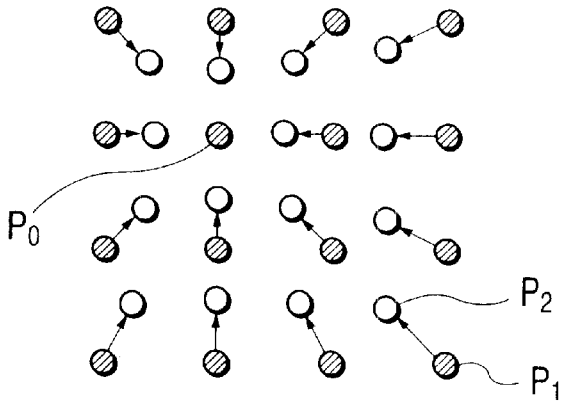
FIG. 5 is a diagram explaining a method of detecting the position of the optical center of the lens from a dot index image.

Reference numeral 5 denotes a screen plate formed of a semitransparent material (such as frosted glass). Three lens supporting portions 4*a* for mounting the lens LE are implanted in the screen plate 5 at equal intervals with a reference axis L as a center, so that the lens LE is mounted at a distance of about 15 mm from the screen plate 5. An index plate 14 having a predetermined target pattern formed thereon is placed within the confines of the lens supporting portions 4*a* in such a manner as to be located directly below the lens LE when the lens LE is mounted. The index plate 14 in this embodiment is arranged such that index dots in the form of a grid are formed on a transparent glass plate, and the index dots are arranged at 0.5 mm pitches in a 20 mm square range with the reference axis L as a center (see FIG. 5). It should be noted that the index plate 14 may be disposed on the illuminating light source side with respect to the lens LE. Further, instead of using the lens supporting portions 4*a* and the index plate 14, a lens mounting base with the lens supporting portions and the index plate formed integrally thereon maybe attached to the screen plate 5. Then, if this lens mounting base is made rotatable about the reference axis L, the lens LE can be rotated by rotating the lens mounting base even if the lens LE is not rotated while being manually held.

Numeral 7 denotes a lens attaching portion for attaching a cup 6, i.e., a processing jig, to the lens LE. The cup attaching portion 7 includes a shaft 7*a* which is rotated by a motor 31 and moved vertically by means of a motor 32, and an arm 7*b* fixed to the shaft 7*a*. The motors 31 and 32 are provided inside the main body 1. An attaching portion 7*c* for fitting a proximal portion of the cup 6 is provided on the underside of a distal end of the arm 7*b*. The cup 6 is attached in a predetermined direction in accordance with a positioning mark provided on an upper surface of the arm 7*b*. When the arm 7*b* is rotated to the position indicated by the dotted lines in FIG. 1 in conjunction with the rotation of the shaft 7*a,* the center of the cup 6 arrives at the reference axis L. It should be noted that the cup attaching portion 7 may be so arranged that the shaft 7*a* is moved linearly in stead of being rotated. Further, the shaft 7*a* may project not from the lower side of the main body 1, but from the upper side thereof.

The cup 6 includes a cup for a normal lens (full-eye cup) 6*a* whose surface for attachment to the lens (outer circumferential shape) is circular, and a cup for a half-eye lens (half-eye cup) 6*b* whose surface for attachment to the lens (outer circumferential shape) is oval. The cup 6*b* is used at the time of processing a half-eye lens (a reading glass lens) which has a narrow vertical length and which causes interference in processing if the cup 6*a* is used.

Figure 3:
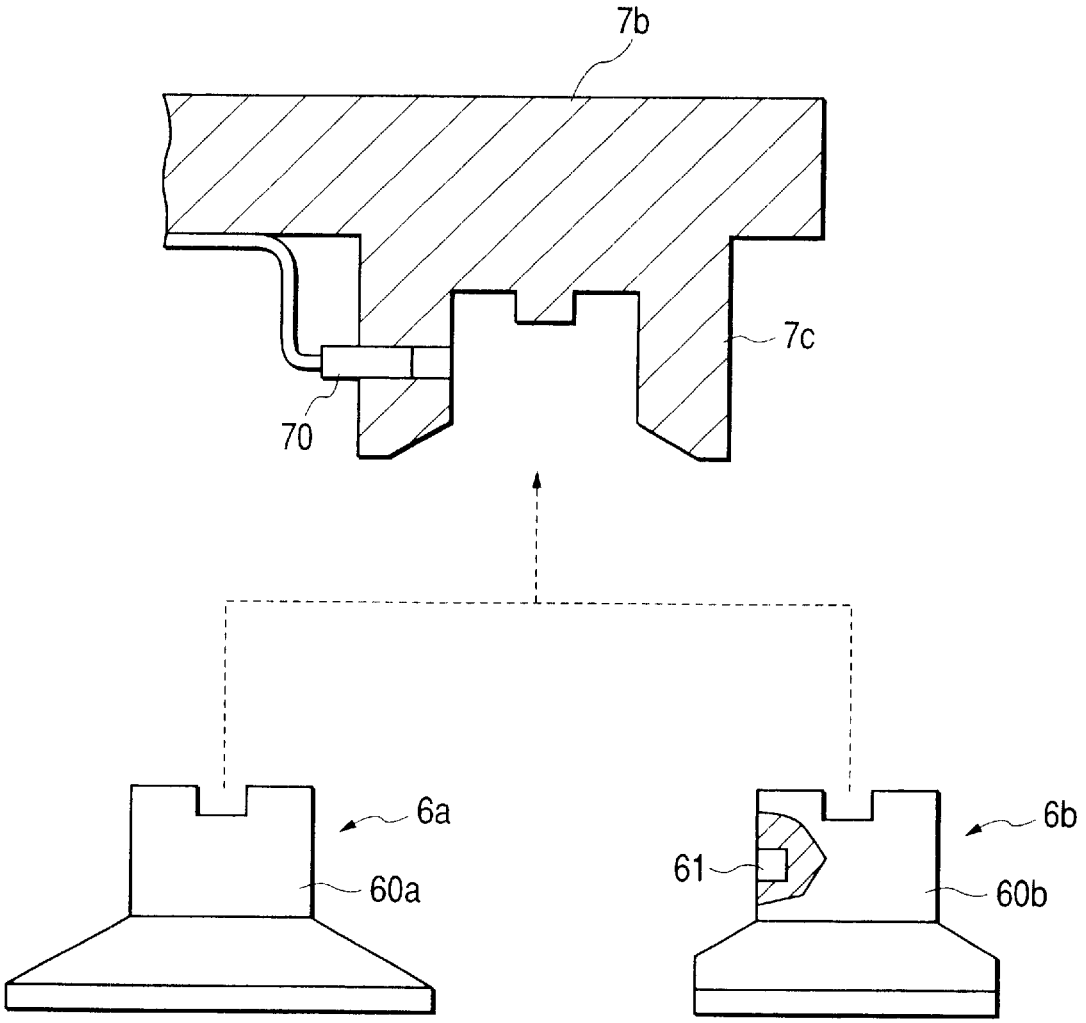
FIG. 3 is a diagram illustrating a mechanism for detecting the type of cup mounted on the cup attaching portion.

As shown in FIG. 3, the attaching portion 7*c* of the cup attaching portion 7 is provided with a photosensor 70 for detecting which one of the cups has been attached. A notched hole 61 for identification is formed in a side surface of a proximal portion 60*b* of the cup 6*b,* whereas the notched hole 61 is not provided in a side surface of a proximal portion 60*a* of the cup 6*a*. When the cup 6*a* is attached to the attaching portion 7*c,* the light emitted from the photosensor 70 is returned by being reflected by the side surface of the proximal portion 60*a*. On the other hand, when the cup 6*b* is attached, the light emitted from the photosensor 70 is reduced due to the notched hole 61 when the light is reflected, and then returned. On the basis of the difference in the reflected light received, the photosensor 70 detects which of the cups has been attached. It should be noted that, as the method of detecting the type of the attached cup, it is possible to use a method in which a metal is embedded in the proximal portion of either the cup 6*a* or the cup 6*b,* and it is detected by a metal detector.

In FIG. 2, reference numeral 10 denotes an illuminating light source. The illuminating light from the light source 10 is converted into substantially parallel rays of light having a larger diameter than that of the lens LE by means of a collimator lens 13, and is then projected onto the lens LE. The light transmitted through the lens LE illuminates the index plate 14, and an overall image of the lens LE and a dot index image of the index plate 14 subjected to the prismatic action of the lens LE are projected onto the screen plate 5. A half mirror 15 is disposed below the screen plate 5, and a first CCD camera 17*a* is provided on the reference axis L in the direction of its transmittance. This first camera 17*a* is disposed so as to be able to image in enlarged form only a central region with the reference axis L set as a center so that the dot index image projected onto the screen plate 5. can be detected. The reference axis L serves as a cup attachment center. Meanwhile, a mirror 16 and a second CCD camera 17*b* for imaging an image reflected by the mirror 16 are disposed in the reflecting direction of the half mirror 15. This second camera 17*b* is disposed so as to be able to image the entire screen plate 5 so that the overall image of the lens LE projected onto the screen plate 5 can be obtained.

Figure 4:
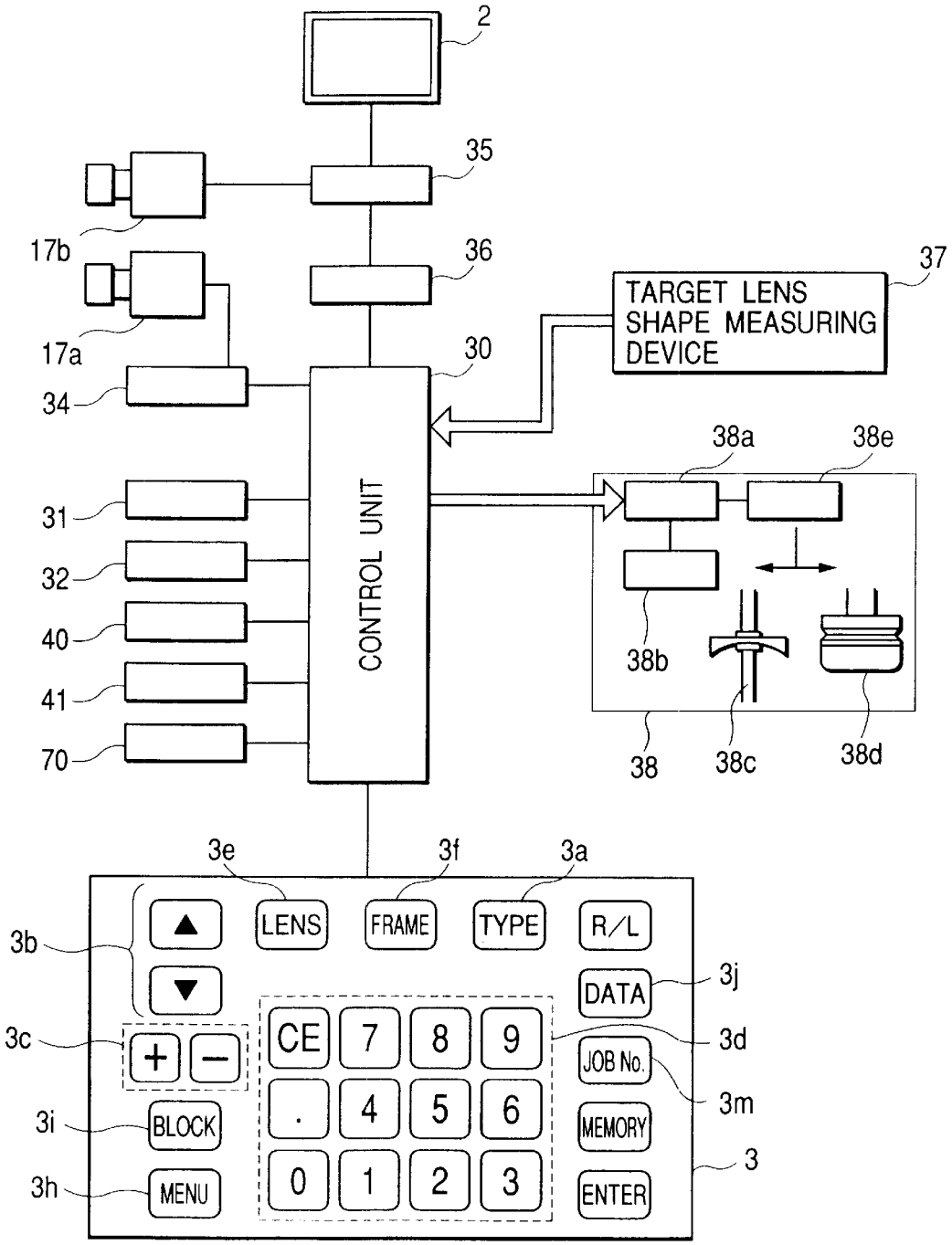
FIG. 4 is a block diagram of a control system of the apparatus.

FIG. 4 is a block diagram illustrating a controlling system of the apparatus. An image signal from the first camera 17*a* is inputted to an image processing unit 34. The processing unit 34 effects image processing to detect the position of the index image, and inputs the detected signal to a control unit 30. On the basis of the detected signal thus inputted, the control unit 30 determines the position of the optical center of the lens LE and the direction (angle) of the cylinder axis (astigmatism axis) (which will be described later). Meanwhile, an image signal from the second camera 17*b* is inputted to an image synthesizing circuit 35, and the circuit 35 combines the image of the lens LE with characters, marks and so on generated by a display circuit 36 connected to the control unit 30, and displays the same on the monitor 2.

Furthermore, also connected to the control unit 30 are the motor 31 for rotating the shaft 7*a*, the motor 32 for vertically moving the shaft 7*a,* a memory 40 for storing the inputted data and the like, a buzzer 41, the photosensor 70, the switch panel 3, a target lens shape measuring device (frame tracer) 37 for measuring a target lens shape (traced outline) of an eyeglass frame, a template (pattern), a dummy lens, or the like, and a lens processing apparatus (lens edger) 38 for grinding the lens LE.

A description will be given of a method of determining the position of the optical center of the lens LE and the direction of the cylinder axis on the basis of the image obtained by the first camera 17*a*.

When the lens LE is not mounted on the lens supporting portions 4*a,* the dot index on the index plate 14 is illuminated by the parallel rays of light, so that the dot index image is projected as it is onto the screen plate 5. On the basis of the image picked up by the first camera 17*a* with the lens LE not mounted, the processing unit 34 determines the coordinate positions of images of dots of the dot index image, and stores the same in advance. When the lens LE is mounted on the lens supporting portions 4*a,* the position of the dot image located immediately below the vicinity of the optical center of the lens LE remains the same irrespective of the presence or absence of the lens LE, but the coordinate positions of the dot images located at portions which are not at the optical center are changed due to the prismatic action of the lens LE. Accordingly, to detect the position of the optical center, a change in the coordinate position of each dot image with the lens LE mounted with respect to the coordinate position of each dot image with the lens LE not mounted is examined, and a center position where the dot images diverge from or converge toward is determined. Namely, the center position of this divergence or convergence can be detected as the position of the optical center. In the example shown in FIG. 5, for instance, when the lens is mounted, dot images $P_1$ with the lens LE not mounted converge (move) with a dot image $P_0$ as the center to become dot images $P_2$. Accordingly, the coordinate position of the dot image $P_0$ can be detected as the position of the optical center. Even if the optical center is located between dots, it suffices if the optical center is determined by interpolating the center of movement on the basis of the moving directions of the dot images and the amounts of their movement.

When the lens LE has cylindrical power (astigmatism power), the dot images move in a direction toward (or away from) a generating line of the lens LE. Hence, the direction of the cylinder axis can be similarly detected by examining in which. directions the dot images are moving with respect to the coordinate positions of the dot images with the lens LE not mounted.

Figure 6:
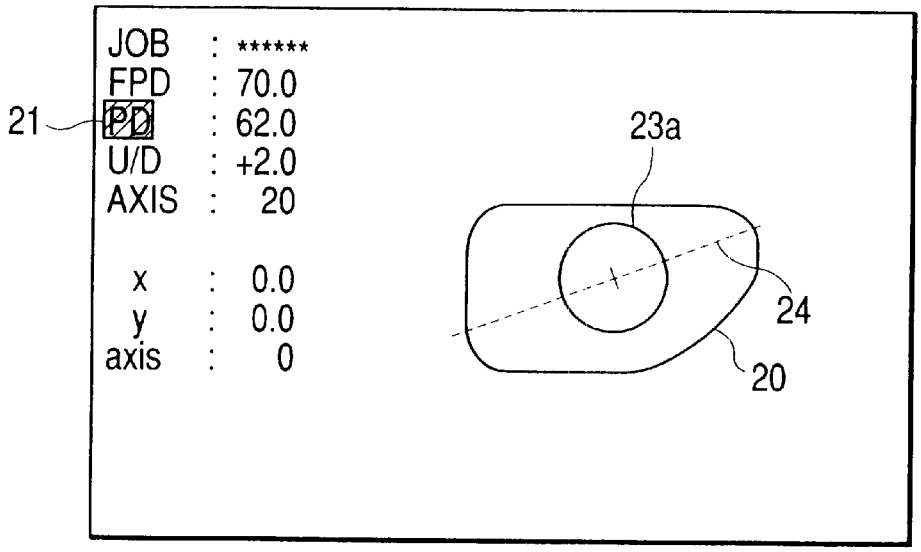
FIG. 6 is a diagram illustrating an example of a screen before the lens is mounted.

Next, a description will be given of the operation of the apparatus having the above-described configuration. First, the target lens shape (traced outline) of the eyeglasses frame (or template, dummy lens, or the like) into which the lens LE is to be fitted is measured by the target lens shape measuring device (frame tracer) 37 connected to the main body 1. Subsequently, if a DATA key 3j is pressed, data on the measured target lens shape (traced outline) is inputted. The inputted target lens shape (traced outline) data is stored in the memory 40, and a target lens shape (traced outline) FIG. 20 based on the inputted target lens shape (traced outline) data is displayed on the monitor 2 (see FIG. 6). The operator inputs frame-fitting conditions, including layout data on the lens LE with respect to the target lens shape (traced outline) and the type of the lens LE, by operating the switch panel 3. The type of the lens LE is selected by a TYPE key 3*a*.

If a unifocal lens mode is selected by the TYPE key 3*a,* input items for the layout of the lens LE are displayed on the left-hand side of the screen of the monitor 2, so that a highlighted cursor 21 is moved by a cursor moving key 3*b* to select items to be inputted. The values of the input items can be changed by a "+" "−" key 3*c* or a ten-key pad 3*d,* and layout data, including FPD (the distance between geometric centers of both eyeglass frame portions), PD (pupillary distance), and U/D (the height of the optical center with respect to the geometric center of each eyeglass frame portion), are inputted. In addition, when the lens LE has cylindrical power, the cursor 21 is moved to the item AXIS, and the angle of the cylinder (astigmatic) axis in the prescription is inputted in advance (or the angle of the cylinder (astigmatic) axis is set to 180° or 90°).

Incidentally, at the time of inputting data, the layout data may be transferred to the lens processing apparatus (lens edger) 38, and the type of the lens LE (such as plastic or glass) and the type of the eyeglasses frame (such as metal or cell) may be inputted in advance by a LENS key 3*e,* a FRAME key 3*f,* and the like for convenience sake, so that processing can be performed directly by using the layout data. In a case where the shape of the eyeglass frame has been measured, the frame shape data (three-dimensional data) is transferred to the lens processing apparatus (lens edger) 38.

In addition to the target lens shape (traced outline) FIG. 20, a cup FIG. 23*a* indicating the shape of the cup 6*a* to be attached to the lens LE is displayed in red color on the screen of the monitor 2 (see FIG. 6) by using as the center the position on the screen corresponding to the reference axis L which is the center of cup attachment. The data on the shape of the cup 6*a* for displaying the cup FIG. 23*a* is stored in advance in the memory 40. In a state prior to the mounting of the lens LE, the target lens shape (traced outline) FIG. 20 is displayed in such a state that the layout optical center (eyepoint position) is aligned with the center of the cup FIG. 23*a*. In addition, if the data on the angle of the cylinder (astigmatic) axis is inputted, an AXIS mark 24 inclined in the direction of that angle is displayed in red color.

When necessary data have been inputted, the operator mounts the lens LE on the lens supporting portions 4*a,* and performs alignment for attaching the cup. If the center of the lens LE is made to be located in the vicinity of the center of the screen plate 5 (such that the position of the optical center of the lens LE is located within the dot index of the index plate 14), an image of the lens LE and a dot index image are projected onto the screen plate 15. The second camera 17*b* picks up an entire image of the lens LE, and its picked-up image LE' is displayed on the screen of the monitor 2 (see FIG. 7). The dot index image projected onto the screen plate 15 is picked up by the first camera 17*a*. The image signal is inputted to the processing unit 34, and the control unit 30 continuously obtains information on the displacement (offset) of the position of the optical center from the reference axis L and information on the direction of the cylinder axis on the basis of information on the coordinate positions of dot index images detected by the image processing unit 34.

Figure 7:
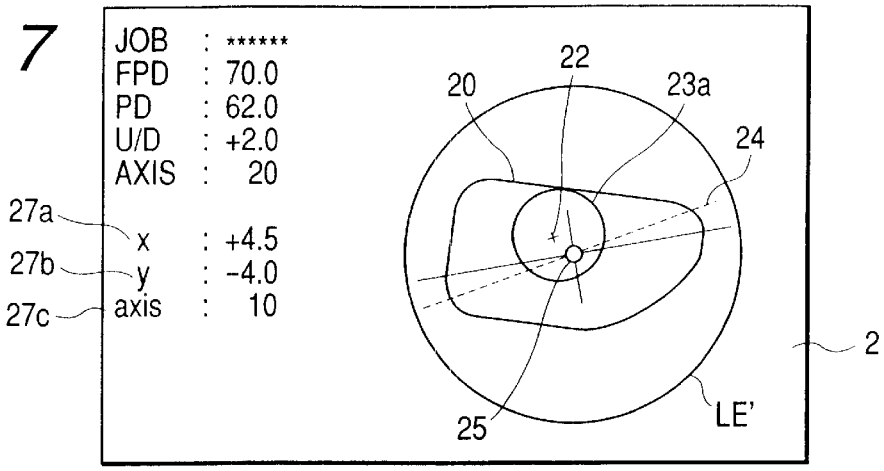
FIG. 7 is a diagram illustrating an example of a screen when the lens has been mounted.

After these items of information are obtained, a cross mark 25 indicating the position of the optical center of the lens is displayed in white color by the display circuit 36 which is controlled by the control unit 30, as shown in FIG. 7. This cross mark 25 is displayed such that the center of a circle "○" depicted in the center conforms to the detected position of the optical center of the lens LE, and such that the long axis of the cross mark 25 is inclined to conform to the information on the direction of the cylinder axis detected. Further, the red ASIX mark 24 indicating the angular direction of the cylinder (astigmatic) axis inputted is displayed with the center of the cross mark 25 (the position of the optical center of the lens LE) as a reference.

In addition, the target lens shape (traced outline) FIG. 20 is displayed such that the position of the layout optical center (eyepoint position) is aligned with the detected position of the optical center of the lens LE, and such that the inputted angular direction of the cylinder (astigmatic) axis conforms to the detected direction of the cylinder axis of the lens LE. Further, since this target lens shape (traced outline) FIG. 20 is displayed by being superposed on the lens image LE', by observing the two images at this stage the operator is able to instantly determine whether or not the lens diameter is insufficient for processing.

The alignment operation for attaching the cup 6 at the position of the optical center of the lens LE is performed as follows. Since a reference mark 22 serving as a target for positioning is displayed in red color at the center of the cup FIG. 23*a* on the screen, the operator moves the lens LE so that the center of the reference mark 22 and the center of the cross mark 25 are aligned, thereby effecting the alignment of the position of the optical center of the lens LE with respect to the reference axis L. As for the alignment of the direction of the cylinder axis, the lens LE is rotated so that the long axis of the cross mark 25 conforms to the direction of the AXIS mark 24. At this time, since the AXIS mark 24 serving as a target for alignment is displayed with the detected position of the optical center of the lens LE as a reference, the alignment of the direction of the cylinder axis can be concurrently effected while performing the alignment of the position of the optical center. In addition, since the alignment of the position of the optical center can be effected after substantially completing the alignment of the direction of the cylinder axis, the degree of offset of the center accompanying the rotational movement of the lens LE is reduced, so that the efficiency in the alignment operation can be achieved.

It should be noted that information on the displacement (offset) of the position of the optical center with respect to the reference axis L is displayed in display items 27*a* and 27*b* on the left-hand side of the monitor 2 as numerical values of distance (unit: mm) by x and y. Further, the detected angle of the cylinder axis is numerically displayed in a display item 27*c*. Through these displays as well, the operator is able to know position information necessary for alignment. In addition, since the amount of fine alignment adjustment can be recognized by the numerical displays, the alignment operation can be performed more simply.

Figure 8:
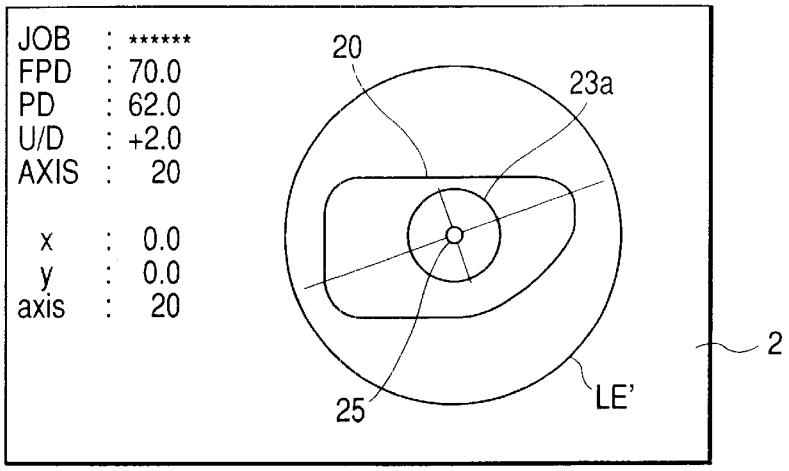
FIG. 8 is a diagram illustrating an example of the screen when lens alignment has been completed.

When the direction of the cylinder axis detected with respect to the inputted angular direction of the cylinder (astigmatic) axis has fallen within a predetermined allowable range, as shown in FIG. 8, the white cross mark 25 is superposed on the AXIS mark 24, and the display of the red AXIS mark 24 disappears. Meanwhile, when the position of the optical center detected with respect to the position of the reference axis L has fallen within a predetermined allowable range, the display of the reference mark 22 disappears such that the reference mark 22 is hidden by the circle "○" depicted in the center of the cross mark 25. Then, upon completion of the alignment of both the direction of the cylinder axis and the position of the optical center, the color of the cup FIG. 23*a* changes from red to blue. Through the change of the mark for alignment and the change of the color of the cup FIG. 23*a,* the operator is able to ascertain the completion of alignment. In addition, in the example shown in FIG. 8, since the cup FIG. 23*a* is accommodated within the target lens shape (tranced outline) FIG. 20, it is possible to confirm that no processing interference will occur at the time of processing by the lens processing apparatus (lens edger) 38.

At the time of this alignment, the control unit 30 determines whether or not the outer circumferential shape of the cup FIG. 23*a* is accommodated within the target lens shape (traced outline) indicated by the target lens shape (traced outline) FIG. 20, i.e., the presence or absence of processing interference if the full-eye cup 6*a* is attached. If it is determined that the cup FIG. 23*a* (the outer circumferential shape of the cup 6*a* ) cannot be accommodated within the target lens shape (traced outline) FIG. 20 (target lens shape. (traced outline)), the display changes from the cup FIG. 23*a* to a cup. FIG. 23*b*. The data on the shape of the cup 6*b* for displaying this cup FIG. 23*b* is also stored in advance in the memory 40. From the fact that. the display has changed to the cup FIG. 23*b,* the operator is able to instantly understand that the cup to be attached should be changed to the cup 6*b*. It should be noted that in a case where the cup FIG. 23*b* cannot be accommodated within the target lens shape (traced outline) FIG. 20 even after the change to the cup FIG. 23*b,* the display of the cup FIG. 23*b* flashes, thereby warning the operator that processing interference will occur. In this case, the operator effects a change to the layout based on the frame center (the geometric center of the frame).

Upon completion of the alignment of the position of the optical center of the lens LE and the direction of the cylinder axis, the operator presses a BLOCK key 3*i* for instructing the cup attachment. The control unit 30 confirms whether the result of detection from the photosensor 70 for detecting which of the cup 6*a* and the cup 6*b* has been attached and the result of determination as to whether or not the cup FIG. 23*a* is accommodated within the target lens shape (traced outline) FIG. 20 in the above-described manner agree with each other. Then, as shown in FIG. 8, if the cup FIG. 23*a* is accommodated within the target lens shape (traced outline) FIG. 20 and the cup 6*a* is mounted on the attaching portion 7*c,* the control unit 30 drives the motor 31 to rotate the shaft 7*a* so as to allow the cup 6*a* to arrive at the reference axis L. The control unit 30 then drives the motor 32 to lower the cup 6*a* and allows the lens LE to be sucked and fixed by the cup 6*a* or to be fixed with a pressure sensitive adhesive sheet placed therebetween.

Figure 9:
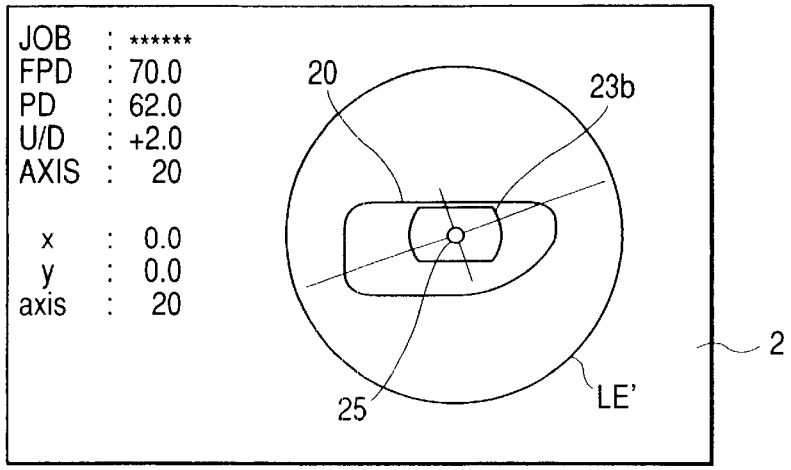
FIG. 9 is a diagram illustrating an example in which a display has been changed to a half-eye cup figure.

Here, in a case where the cup 6*a* is mounted on the attaching portion 7*c* despite the fact that the display has been changed to the cup FIG. 23*b* as shown in FIG. 9, even if a command signal from the BLOCK key 3*i* is inputted, the control unit 30 does not operate the cup attaching portion 7 and inhibits the attachment of the cup 6*a*. At the same time, a message indicating that a change to the cup 6*b* is required is displayed on the screen of the monitor 2, and an alarm sound is generated by a buzzer 41. In addition, this also applies to an opposite case, and in a case where the cup 6*b* has been mounted although a determination has been made that the attachment of the cup 6*a* is possible, the message indicating this inconsistency is displayed, and the alarm sound is generated.

Since the cup attaching operation is effected or inhibited depending on the detection of the type of the cup which has been mounted on the cup attaching portion 7 and the determination of the type of cup which is-appropriate for the target lens shape (traced outline) when the attaching command has been issued, it is possible to prevent the attachment of an inappropriate cup.

It should be noted that although the arrangement provided is such that the operator operates the BLOCK key 3*i* at the time of attaching the cup, it is also possible to operate the cup attaching portion 7 (the motors 31 and 32) by automatically issuing a signal after the. control unit 30 determines the completion of the alignment. In this case, the control unit 30 causes the buzzer 41 to issue an alignment completion sound, thereby informing the operator that the cup attaching portion 7 will operate automatically. As to whether the operation of the cup attaching portion 7 is to be effected manually or automatically, various setting screens are opened on the monitor 2 by pressing a MENU key 3*h,* and a setting is provided in advance on the setting screen.

Although a description has been given of the case where the cup 6 is attached to the position of the optical center of the lens LE, in this apparatus, the cup 6 may be attached to an arbitrary position, and information on that attached position may be used as correction information for coordinate transformation at the time of processing by the lens processing apparatus (lens edger) 38. As for the alignment of the lens LE in this case, if the lens LE is moved so that the cup FIG. 23*a* is accommodated within the target lens shape (traced outline) FIG. 20 as shown in FIG. 7, it is possible to prevent the cup 6*a* from causing processing interference, so that the cup attachment is possible in this state.

As for the alignment in the direction of the cylinder axis as well, information on offset between the inputted angular direction of the cylinder (astigmatic) axis and the detected direction of the cylinder axis can be obtained, and this offset information can be corrected on the lens processing apparatus (lens edger) 38 side, so that accurate alignment is unnecessary. Since the target lens shape (traced outline) FIG. 20 is displayed in correspondence with the detected angular direction of the cylinder axis (i.e., it is displayed by being inclined in correspondence with the amount of offset of the angle of the cylinder axis), if confirmation is made that the cup FIG. 23*a* can be accommodated within the target lens shape (traced outline) FIG. 20, it is possible to attach the cup at the position where processing interference can be avoided.

Figure 10A:
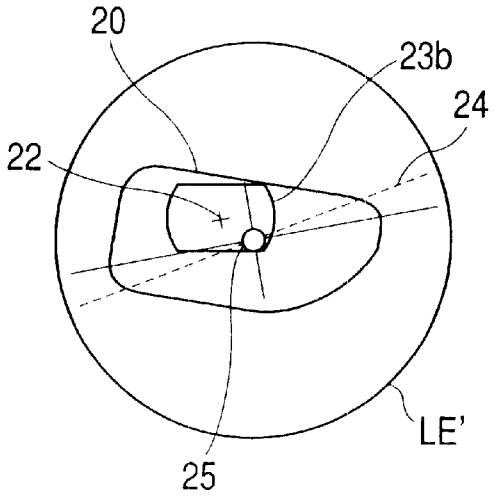
FIGS. 10A and 10B are diagrams explaining an example in which the display is changed to a half-eye cup figure and a full-eye cup figure, respectively.
Figure 10B:
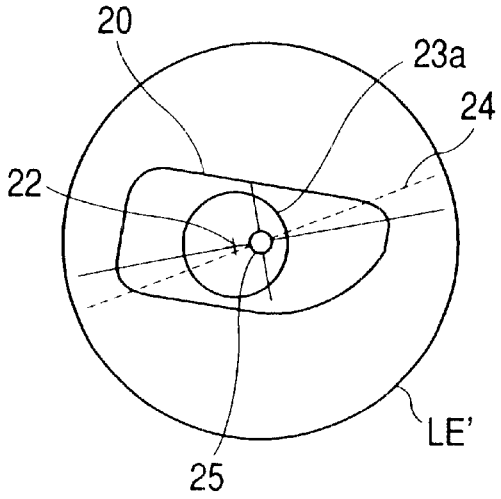

At the time of attaching the cup at such an arbitrary position, if it is determined that the shape of the cup 6*a* cannot be accommodated within the target lens shape (traced outline) FIG. 20 which is set by using the detected optical center position as a reference, that is, if it is determined that processing interference will occur, the display is changed to the cup FIG. 23*b,* as shown in FIG. 10A. FIG. 10A shows an example of the half-eye lens having a narrow vertical length, and since the cup FIG. 23*b* is accommodated within the target lens shape (traced outline) FIG. 20, the cup 6*b* may be attached, but it is preferable to attach the cup 6*a,* if possible. Accordingly, in such a case, by moving the lens LE, if the display is changed to the cup FIG. 23*a* as shown in FIG. 10B, it is possible to attach the cup 6*a*.

Upon confirming that the cup FIG. 23*a* (or 23*b*) is accommodated within the target lens shape (traced outline) FIG. 20, the operator turns on the BLOCK key 3*i*. This in turn causes the control unit 30 to drive the cup attaching portion 7, so that the cup 6*a*(or 6*b*) is attached to the lens LE. Concurrently, information on the displacement (offset) of the position of the optical center and information on the displacement (offset) of the direction of the cylinder axis at this time are stored in the memory 40.

It should be noted that, at the time of performing the cup attachment, a job number is inputted in advance by operating a JOB key 3*m* and the ten-key pad 3*d,* so that the target lens shape (traced outline) data, the layout data, the information on the displacement (offset) of the position of the optical center, the information on the displacement (offset) of the direction of the cylinder axis, and the like which are stored in the memory 40 can be managed by the job number.

After the attachment of the cup, the stored data is read out by designating the job number, and is inputted to the lens processing apparatus (lens edger) 38. As the lens processing apparatus (lens edger) 38, it is possible to use the one disclosed in U.S. Pat. No. 5,716,256. In the lens processing apparatus (lens edger) 38, if the job number is inputted by an input section 38*b* (e.g., a work slip with a bar code marked in correspondence with the job number is read by a bar-code scanner), the lens data corresponding to the job number is read from the cup attaching apparatus body 1, and is inputted.

In the lens processing apparatus (lens edger) 38, the lens LE is chucked by two lens rotating shafts 38*c,* and a moving mechanism 38*e* for changing the distance between a rotating shaft of a grinding wheel 38*d* for processing and the lens rotating shafts 38*c* is operated so as to perform processing on the basis of the inputted data. At this time, a control unit 38*a* of the lens processing apparatus (lens edger) 38 applied, onto the processing data obtained from the target lens shape (traced outline) data and the layout data, the coordinate transformation of the displacement of the position of the optical center and the offset of the direction of the cylinder axis when the cup is attached, to obtain corrected new processing data. The control unit 38*a* controls the processing on the basis of the corrected new processing data. Thus, even if the cup is attached to an arbitrary position, the position is corrected in processing and therefore, the lens LE is processed without an error.

As described above, in accordance with the invention, even an unskilled operator is able to easily determine the type of an appropriate cup at the time of attaching the cup. Furthermore, it is possible to prevent the error of attaching an inappropriate cup.

What is claimed is:

1. A cup attaching apparatus for attaching an appropriate one of cups onto an eyeglass lens, each cup being adapted to fix the eyeglass lens onto a lens rotating shaft of a lens processing apparatus, the cup attaching apparatus comprising:

cup attaching means for moving a cup to a lens placed at a predetermined position, and attaching the cup onto the lens;

detecting means, provided with a measurement optical system having a measurement light source, a measurement index plate and an photoelectric detector, for detecting a position of an optical center of the lens;

display means for displaying a positional offset of the lens relative to a predetermined reference position based on a result of detection by the detecting means;

data input means for inputting data on a target lens shape or a traced outline and a layout of the lens;

a memory for storing data on shapes of plural types of cups; and selecting means for selecting a cup, which will not interfere with an abrasive wheel during processing of the lens, based on inputted data and stored data on the shapes of the cups.

2. The cup attaching apparatus according to claim 1, further comprising:

display controlling means for controlling the display means to display the result of selection by the selecting means.

3. The cup attaching apparatus according to claim 2, wherein the display controlling means controls the display means to graphically display a shape of the cup selected.

4. The cup attaching apparatus according to claim 1, further comprising:

cylinder axis angle inputting means for inputting a cylinder axis angle indicated in a prescription, wherein the detecting means further detects a cylinder axis angle of the lens, and wherein the display means displays a guide instruction for rotating at least one of the cup and the lens, based on the inputted cylinder axis angle and the detected cylinder axis angle.

5. The cup attaching apparatus according to claim 1, wherein the display means superimposes and displays an optical center mark indicative of the detected position of the optical center, a target lens shape mark based on the inputted data, and a cup mark based on the stored data on the shapes of the cups, the cup mark including a mark indicative of a center of the cup.

6. The cup attaching apparatus according to claim 1, further comprising:

lens shape inputting means for inputting an outer circumferential shape of the lens, wherein the display means superimposes and displays a lens mark based on the inputted outer circumferential shape of the lens, a target lens shape mark based on the inputted data, and a cup mark based on the stored data on the shapes of the cups, the lens mark including a mark indicative of the optical center of the lens, and the cup mark including a mark indicative of a center of the cup.

7. The cup attaching apparatus according to claim 6, wherein the lens shape inputting means includes imaging means for imaging the lens placed at the predetermined position.

8. The cup attaching apparatus according to claim 1, wherein the plural types of the cups includes a circular cup for normal lenses and an oval cup for half-eye lenses.

9. The cup attaching apparatus according to claim 1, further comprising:

cup detecting means for detecting a type of the cup held by the cup attaching means;

inhibiting means for inhibiting the attachment of the cup by the cup attaching means if the result of selection by the selecting means is not identical to a result of detection by the cup detecting means.

10. The cup attaching apparatus according to claim 1, further comprising:

cup detecting means for detecting a type of the cup held by the cup attaching means;

notifying means for notifying a fact that the result of selection by the selecting means is not identical to a result of detection by the cup detecting means.

11. The cup attaching apparatus according to claim 1, further comprising:

judging means for judging whether-or not the detected position of the optical center falls within a predetermined range with respect to the predetermined reference position;

cup detecting means for detecting a type of the cup held by the cup attaching means; and instructing means for instructing the cup attaching means to attach the cup if the judging means judges that the detected position of the optical center falls within the predetermined range and the result of selection by the selecting means is identical to a result of detection by the cup detecting means.

12. The cup attaching apparatus according to claim 1, further comprising:

transmitting means for transmitting data to the lens processing apparatus.

13. The cup attaching apparatus according to claim 1, further comprising:

storing means for storing an amount of the positional offset of the lens with respect to the predetermined reference position at the time of cup attachment; and transmitting means for transmitting the stored amount of the positional offset of the lens to the lens processing apparatus.

14. A cup attaching apparatus for attaching an appropriate one of cups onto an eyeglass lens, each cup being adapted to fix the eyeglass lens onto a lens rotating shaft of a lens processing apparatus, the cup attaching apparatus comprising:

cup attaching means for moving a cup to a lens placed at a predetermined position, and attaching the cup onto the lens;

detecting means, provided with a measurement optical system having a measurement light source, a measurement index plate and a photoelectric detector, for detecting a position of an optical center of the lens and a direction of a cylinder axis of the lens;

data input means for inputting data on a target lens shape or a traced outline and a layout of the lens;

a memory for storing data on shapes of plural types of cups; and display means for relatively displaying a cup mark with respect to an optical center mark and relatively displaying a target lens shape mark with respect to the optical center mark, the cup mark being based on stored data on the shapes of the cups and including a mark indicative of a center of the cup, the optical center mark being indicative of the detected position of the optical center and the target lens shape mark being based on the inputted data.

15. The cup attaching apparatus according to claim 14, further comprising:

selecting means for selecting a cup, which will not interfere with an abrasive wheel during processing of the lens, based on the inputted data and the data on the shapes of the cups.

16. The cup attaching apparatus according to claim 15, wherein the cup mark is displayed by the displaying means based on a result of selection by the selecting means.

17. The cup attaching apparatus according to claim 15, wherein the selecting means selects a circular cup with priority.

18. The cup attaching apparatus according to claim 15, further comprising:

cup detecting means for detecting a type of the cup held by the cup attaching means;

inhibiting means for inhibiting the attachment of the cup by the cup attaching means if the result of selection by the selecting means is not identical to a result of detection by the cup detecting means.

19. The cup attaching apparatus according to claim 15, further comprising:

cup detecting means for detecting a type of the cup held by the cup attaching means;

notifying means for notifying a fact that the result of selection by the selecting means is not identical to a result of detection by the cup detecting means.

20. The cup attaching apparatus according to claim 15, further comprising:

judging means for judging whether or not the detected position of the optical center falls within a predetermined range with respect to a position of a center about which the cup is to be attached;

cup detecting means for detecting a type of the cup held by the cup attaching means; and instructing means for instructing the cup attaching means to attach the cup if the judging means judges that the detected position of the optical center falls within the predetermined range and the result of selection by the selecting means is identical to a result of detection by the cup detecting means.

21. The cup attaching apparatus according to claim 14, further comprising:

cylinder axis angle inputting means for inputting an angle of the cylinder axis indicated in a prescription, wherein the display means relatively displays a first axis mark based on the inputted angle of the cylinder axis and a second axis mark based on the detected direction of the cylinder axis with respect to the optical center mark.

22. The cup attaching apparatus according to claim 14, further comprising:

lens shape inputting means for inputting an outer circumferential shape of the lens, wherein the display means relatively displays a lens mark based on the inputted outer circumferential shape of the lens with respect to the optical center mark.

23. The cup attaching apparatus according to claim 14, wherein the plural types of the cups includes a circular cup for normal lenses and an oval cup for half-eye lenses.

* * * * *